United States Patent [19]

Lapadakis

[11] Patent Number: 4,875,634

[45] Date of Patent: Oct. 24, 1989

[54] PAPER TAPE ROLL CONTROL UNIT

[76] Inventor: Theodore Lapadakis, 9827 Mason Ave., Chatsworth, Calif. 91311

[21] Appl. No.: 223,782

[22] Filed: Jul. 25, 1988

[51] Int. Cl.[4] ..... B65H 16/06

[52] U.S. Cl. ..... 242/67.3 R; 235/58 CF

[58] Field of Search ..... 242/55, 67.3 R, 67.1 R, 242/99, 75.5, 75.51; 235/58 CF; 400/614, 614.1; 225/82, 89, 106

[56] References Cited

U.S. PATENT DOCUMENTS

| | | | |
|---|---|---|---|
| 1,131,849 | 5/1915 | Magnus | 242/67.3 R |
| 1,212,068 | 1/1917 | Jones et al. | 225/89 |
| 1,347,884 | 7/1920 | White et al. | 242/67.3 R |
| 1,436,218 | 11/1922 | Tindall et al. | 242/67.3 R |
| 1,537,971 | 11/1921 | Sundstrand | 242/67.3 R |
| 1,604,794 | 10/1926 | Sutton | 242/67.3 R |
| 1,762,749 | 5/1928 | Tauschek | 400/614 |
| 1,825,783 | 2/1930 | Dunning et al. | 242/67.3 R |
| 3,306,548 | 2/1967 | Polder | 242/67.3 |
| 3,338,531 | 9/1965 | Novotny | 242/67.3 R |
| 3,447,657 | 6/1969 | Majors | 197/133 |
| 3,652,027 | 3/1972 | Wong | 242/96 |
| 3,738,685 | 6/1973 | Penner | 242/67.3 R |
| 4,116,468 | 9/1978 | Marten | 242/67.4 |
| 4,135,676 | 1/1979 | Hunter | 242/67.3 R |
| 4,168,038 | 9/1979 | Nims | 242/67.3 R |
| 4,469,287 | 9/1984 | Pfister et al. | 242/67.3 R |
| 4,492,345 | 1/1985 | Bakker | 242/67.3 R |
| 4,494,708 | 1/1985 | Stubbs et al. | 242/67.3 R |
| 4,700,906 | 10/1987 | Lapadakis | 242/67.3 R |

FOREIGN PATENT DOCUMENTS

| | | | |
|---|---|---|---|
| 2541477 | 8/1984 | France | 235/58 |

OTHER PUBLICATIONS

I.B.M. Technical Paper by Billings et al, Eddy Current Drive for Take-Up Spool, Jun. 1963.

*Primary Examiner*—David Werner

*Attorney, Agent, or Firm*—Kelly, Bauersfeld & Lowry

[57] ABSTRACT

An improved paper tape control unit is provided for use with calculators, adding machines and the like requiring use of paper tape in roll form. The paper tape control unit supplies the paper tape to the associated machine and provides automatic, intermittent activation of a control unit drive motor to rewind used paper tape discharged from the machine. In one form, the control unit drive motor is coupled with a standard platen drive motor of a business machine for concurrent operation to intermittenly rewind the tape onto a take-up reel. In another form, the control unit drive motor is powered independently by a separate power source such as batteries with a control unit housing to rewind the used tape onto a take-up reel.

13 Claims, 4 Drawing Sheets

PAPER TAPE ROLL CONTROL UNIT

BACKGROUND OF THE INVENTION

This invention relates generally to improved apparatus for handling elongated paper roll tape of the type used with adding machines, calculators, and the like. More particularly, this invention relates to an improved paper tape roll control unit for supplying paper tape to and for simultaneously rewinding paper tape discharged from an adding machine or calculator or the like.

Adding machines, calculators and other types of business machines are well known of the type utilizing elongated strips of so-called paper tape. Typically, an elongated strip of paper tape is supplied in roll form and mounted on the adding machine or calculator, etc., by means of a rotatable spindle which permits the tape to be unrolled for supply to the business machine. The business machine commonly includes a roller platen or a similar mechanism for drawing the tape incrementally from the supply reel into association with a suitable printing head which applies numbers, letters, etc., onto the paper tape. In most cases, the paper tape is permitted to discharge from the machine freely in an unrestrained manner which commonly results in elongated, tangled strips of paper tape which fall onto the floor in an unsightly manner.

A wide variety of paper tape control devices have been proposed for use with adding machines and calculators and the like, particularly to include a take-up reel onto which used paper tape is rewound simultaneously with unwinding of the tape from the supply reel. Many such paper tape control devices are integrated directly into the associated business machine, thereby providing a relatively large and complicated business machine construction. Other paper tape control devices have been designed as add-on components for mounting onto a separate business machine. In the past, such add-on devices have commonly used friction or belt drive interconnections and the like between the paper tape and associated supply and take-up reels in attempts to rewind used tape onto the take-up reel as additional unused tape is fed to the machine from the supply reel. However, with the exception of the system described in applicant's U.S. Pat. 4,700,906, such mechanically linked supply/take-up reel arrangements for the most part have not adequately accounted for the inversely varying reel diameters as paper tape movement progresses. Other add-on systems have proposed the use of separate motors for driving the take-up reel independently of the supply reel or roller platen, as described, for example, in U.S. Pat. Nos. 3,338,531 and 3,447,657. However, such motor driven systems have relied upon substantially continuous motor operation in conjunction with an overrun clutch or the like to obtain intermittent rotation of the tape take-up reel. The prior art has not satisfactorily provided a simple and economical motor driven take-up reel adapted for intermittent motor energization.

The present invention relates to an improved paper tape control device of relatively simple, economical, and reliable construction, wherein a separate motor is provided for automatic intermittent advancement, of a take-up reel.

SUMMARY OF THE INVENTION

In accordance with the invention, an improved paper tape roll, control unit is provided for positioning or for releasable attachment in operative association with a calculator adding machine, or other business machine requiring paper tape in roll form. The improved control unit includes a paper tape supply reel from which paper tape is drawn as required for use in the business machined. The control unit further provides a control unit motor for automatic intermittent activation of a take-up reel to rewind used paper tape discharged from the business machine.

In accordance with a preferred form of the invention, the improved paper tape control unit comprises a relatively compact housing with upstanding side walls having the paper tape supply take-up reels rotatably supported therebetween generally in parallel relation. The housing defines an open front through which the paper tape is wound from the supply reel and rewound onto the take-up reel. Paper tape from the supply reel is directed through the housing, into the business machine and around a roller platen in association with a printer head or the like. Used printed tape discharged from the business machine is automatically rewound on an intermittent basis by the motor driven take-up reel.

In one version of the invention, the take-up reel is driven by a motor which is wired directly to a standard platen drive motor of the business machine. Thus, whenever the platen drive motor is activated during normal operation of the machine to discharge paper tape from the machine, the control unit motor is concurrently energized to power the take-up reel for purposes of rewinding the used paper tape. In an alternative embodiment of the invention, the control unit motor is associated with a power source separate from the platen drive motor. Switch means located within the control unit housing responds to supply reel rotation to provide for the automatic, intermittent activation of the control unit motor which drives the take-up reel for periodic rewinding of the discharged paper tape. The switch means may be associated with a time delay circuit for de-energizing the control unit motor following a predetermined operational time interval.

In accordance with other aspects of the invention, to facilitate review of used paper tape, the paper tape rewound onto the take-up reel can be manually grasped and drawn off the take-up reel for examination. A manually operated switch is provided for control unit motor energization so that the reviewed tape can be rewound immediately without requiring resumption of normal machine operation. The entire process of tape withdrawal and rewinding relative to the take-up reel thus occurs without creation of significant tape slack between the supply and take-up reels.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is an exploded perspective view illustrating a paper tape control unit embodying the novel features of the invention, and shown for use in combination with a business machine such as a calculator, adding machine, or the like;

FIG. 11 is a perspective view illustrating another embodiment of the invention including a paper tape roll control unit attached to a business machine or the like.

DETAILED DESCRIPTION OF THE PREFERRED EMBODIMENTS

Figure 1:
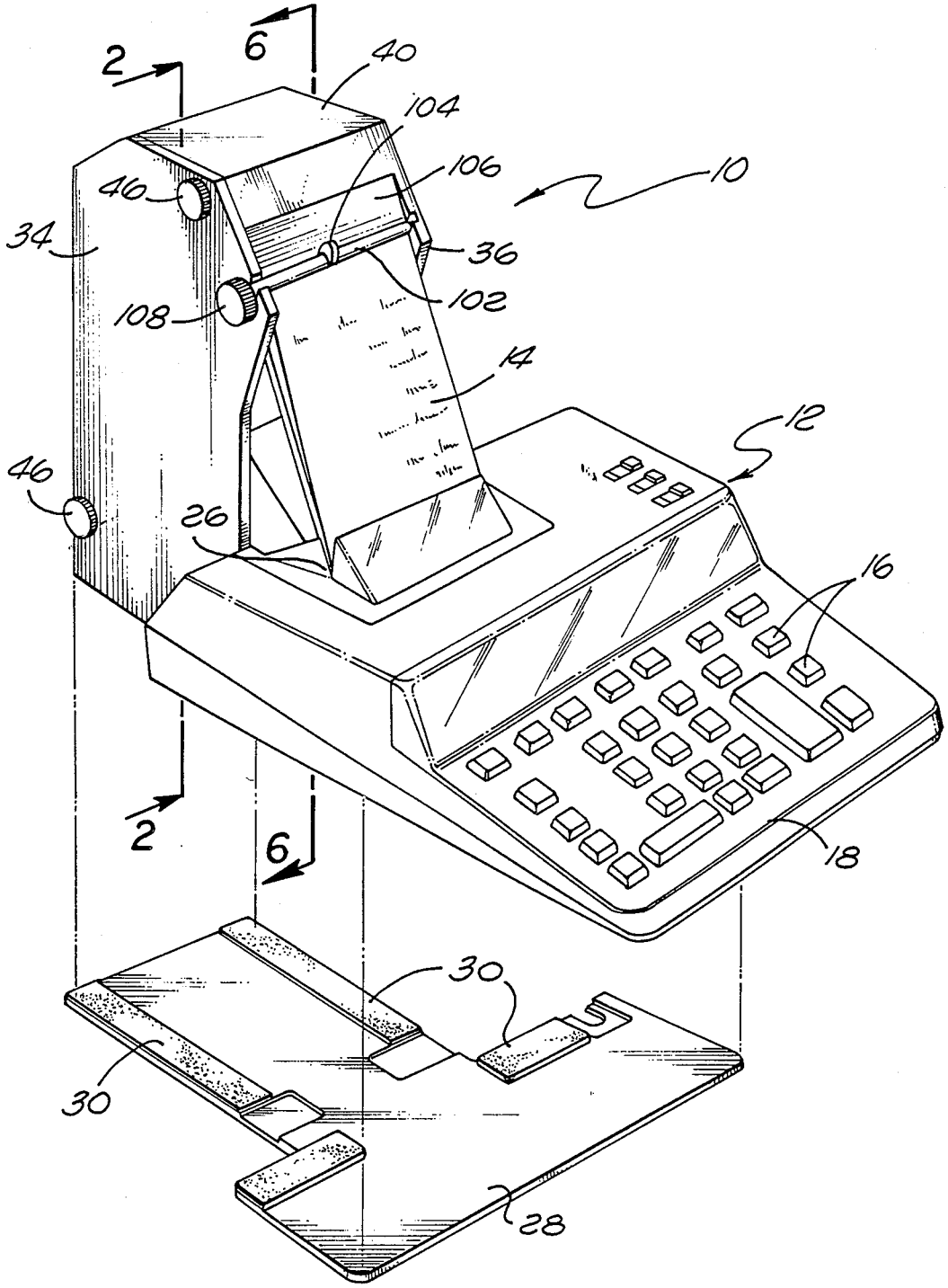

As shown in the exemplary drawings, an improved paper tape roll control unit referred to generally in FIG. 1 by the reference numeral 10 is provided for use in combination with a business machine 12, such as an adding machine, calculator, or the like. The improved paper tape control unit 10 provides means for close, relatively simple control of an elongated strip 14 of paper tape or the like, including means for automatic, intermittent take-up of the paper tape 14 by a take-up reel (not shown in FIG. 1).

The improved paper tape control unit 10 of the present invention provides a relatively simple yet versatile apparatus for facilitated handling of paper tape 14 in roll form with respect to calculators, adding machines and similar business machines and the like. The control unit 10 advantageously rewinds used paper tape as is supplied to and discharged from the machine 12 during normal machine operation, all in a substantially slack-free manner and without significant risk of tape breakage. The control unit 10 rewinds the paper tape in an intermittent but efficient manner to prevent creation of unsightly tangled masses of used tape, and further to permit re-use of the paper tape by printing, for example, on the reverse side thereof. Moreover, the improved control unit 10 beneficially enhances the functional versatility of the business machine 12 by permitting a relatively easy review of used paper tape, and further by facilitating the application of handwritten notes or edits or other indicia onto used paper tape.

Figure 2:
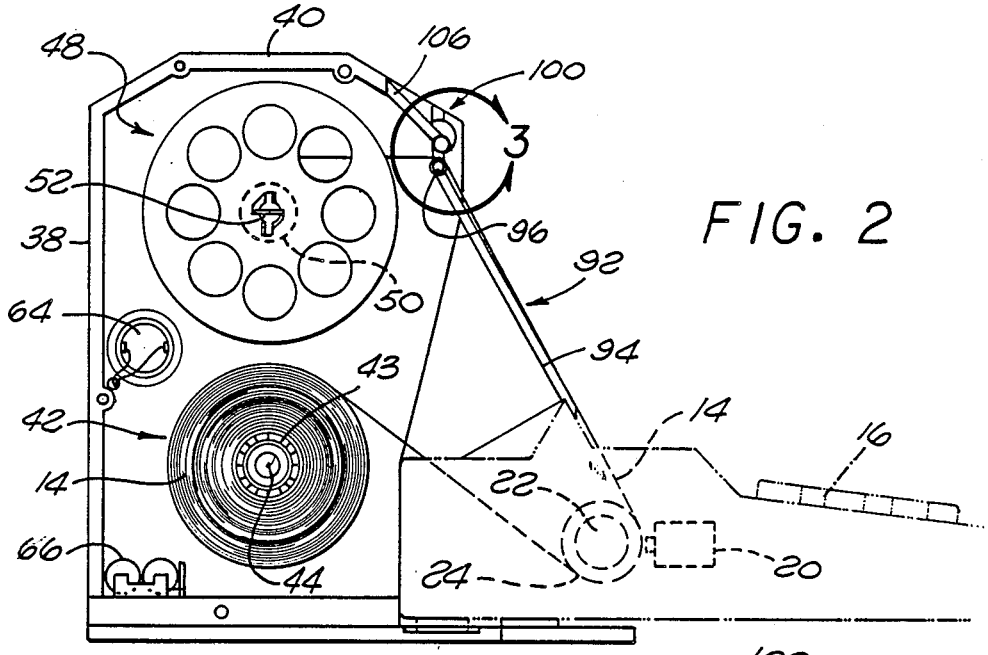
FIG. 2 is a vertical sectional view taken generally on the line 2—2 of FIG. 1.
Figure 5:
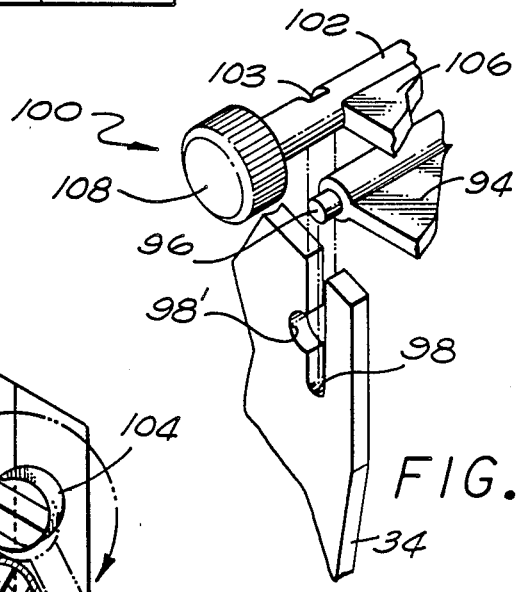
FIG. 5 is an enlarged fragmented and exploded perspective view illustrating further the arrangement of components shown within the encircled region 3 of FIG. 2.
Figure 3:
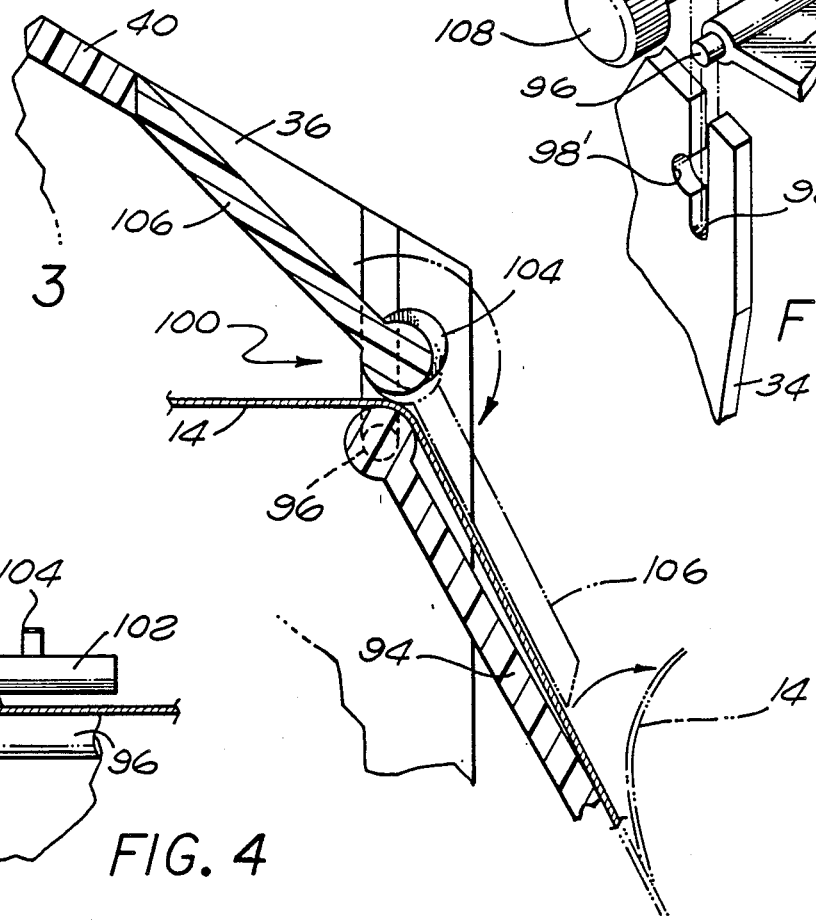
FIG. 3 is an enlarged fragmented vertical sectional view corresponding generally with the encircled region 3 of FIG. 2.
Figure 4:
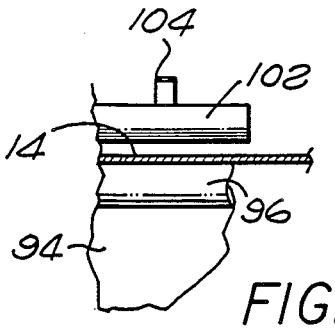
FIG. 4 is a fragmented vertical sectional view taken generally on the line 4—4 of FIG. 3.

As shown generally in FIGS. 1 and 2 in one preferred form of the invention, the improved paper tape control unit 10 is designed to handle paper tape supply and discharge with respect to an adjacent business machine 12, such as the illustrative adding machine. Business machines of this general type traditionally include a plurality of operating keys or buttons 16 mounted in exposed positions on a machine housing 18 for appropriately actuating a printer head 20 located within the housing 18. This printer head 20 is positioned for printing appropriate symbols such as numbers and/or letters onto one side of the paper tape 14 as the tape is drawn into and through the machine 12, for example, by a traditional roller platen 22 or similar tape advancement means. A platen drive motor 24 mounted within the machine housing is provided for operating the roller platen 22 for paper tape advancement, all in a manner known to those skilled in the art. Used paper tape is discharged from the machine housing 18 through an upwardly open slot 26 for discharge from the machine. The traditional means on the machine housing for rotationally supporting a paper tape supply reel is removed to accommodate use of the machine in combination with the paper tape control unit 10 of the present invention.

In general terms, the improved paper tape control unit 10 comprises a relatively compact housing adapted to stand behind the associated business machine 12, as viewed as an add-on device in FIGS. 1 and 2. In this regard, in the illustrative embodiment of the invention, the control unit housing may be secured in position relative to the business machine 12 by mounting both the business machine and the control unit onto a common base 28. Fastening means 30 such as Velcro-type closure members, double sided adhesive tape, or the like, are provided on the base 28 for secure connection to the control unit 10 and the business machine, although other types of relatively simple fastening components such as screws or the like can be used to achieve this connection, as desired. Moreover, is desired, the control unit 10 may be integrated into an expanded business machine formed as an original equipment item.

The control unit housing includes a bottom wall 32 which anchors a pair upstanding side walls 34 and 36 in generally parallel relation. These side walls 34 and 36 are interconnected by a rear wall 38 and a top wall 40. Accordingly, the various housing walls define a generally hollow structure having an open front presented toward the adjacent business machine 12.

A paper tape supply reel 42 (FIG. 1) is mounted within a lower region of the control unit housing between the side walls 34 and 36. The supply reel 42 comprises a spindle 44 having its opposite ends supported in a suitable manner for rotation about a substantially horizontal axis. The supply reel 42 carries a cylindrical hub 43 which supports an elongated and continuous supply of the paper tape 14 in roll form for feeding through the open front of the housing to the business machine 12, as viewed in FIG. 2. The paper tape 14 is threaded about the platen roller 22 for operative association with the printer head 20, as previously described. Conveniently, the side wall 34 of the control unit is removably mounted onto the other housing components by a plurality of manually removable thumbscrews 46 or the like to permit opening of the housing for supply reel access and replacement.

A take-up reel 48 is also mounted within the control unit housing at a position above and in generally parallel relation with the supply reel 42. As viewed best in FIGS. 2 and 6, the take-up reel 48 includes another cylindrical hub 50 adapted for reception onto a take-up spindle 52 having its opposite ends adapted suitable for rotatable support by the housing side walls 34 and 36. A driven pulley 54 (FIG. 6) is fastened to the end of the take-up spindle 52 at an outboard face of the side wall 36, wherein this driven pulley 54 is rotatable with the spindle 52. A retainer disk 56 (FIG. 2) is adapted for mounting onto the opposite end of the take-up spindle 52 at an inboard face of the side wall 34 to assist is guiding used paper tape 14 onto the take-up reel hub 50. That is, paper tape 14 discharged from the business machine is guided through the open front of the control unit housing for rewinding about the take-up hub 50 during normal business machine operation.

The driven pulley 54 is conveniently recessed into a shallow chamber 57 defined in the outboard face of the housing side wall 36, wherein this chamber is adapted for closure during normal machine operation by a cover plate 58 (FIG. 7) A drive belt 60 preferably such as a flexible spring belt or the like (FIG. 6) is wrapped about the driven pulley 54 as well as a relatively smaller drive pulley 62 disposed within the chamber 57. This drive pulley 62 is mounted onto the drive shaft 63 of a control unit drive motor 64 such as a small electric motor mounted conveniently onto the adjacent side wall 36 at an inboard face thereof.

The drive motor 64 for the control unit 10 is associated with a power supply for intermittent operation in an automated manner to rotate the take-up reel 48 for purposes of rewinding used paper tape 14 onto the take-up reel. In the embodiment of FIGS. 1–10, this power supply is separate from the platen drive motor 24 and may be conveniently provided in the form of batteries 66 mounted within a suitable battery compartment 68 (FIG. 8) in the control unit housing. These batteries 66 are coupled electrically by appropriate leads 70 to the control unit motor 64 and associated with switch means for intermittent motor energization. In the preferred form, the switch means comprises two different switch units for automated intermittent operation and for manual operation, as desired by the person using the business machine.

Figure 6:
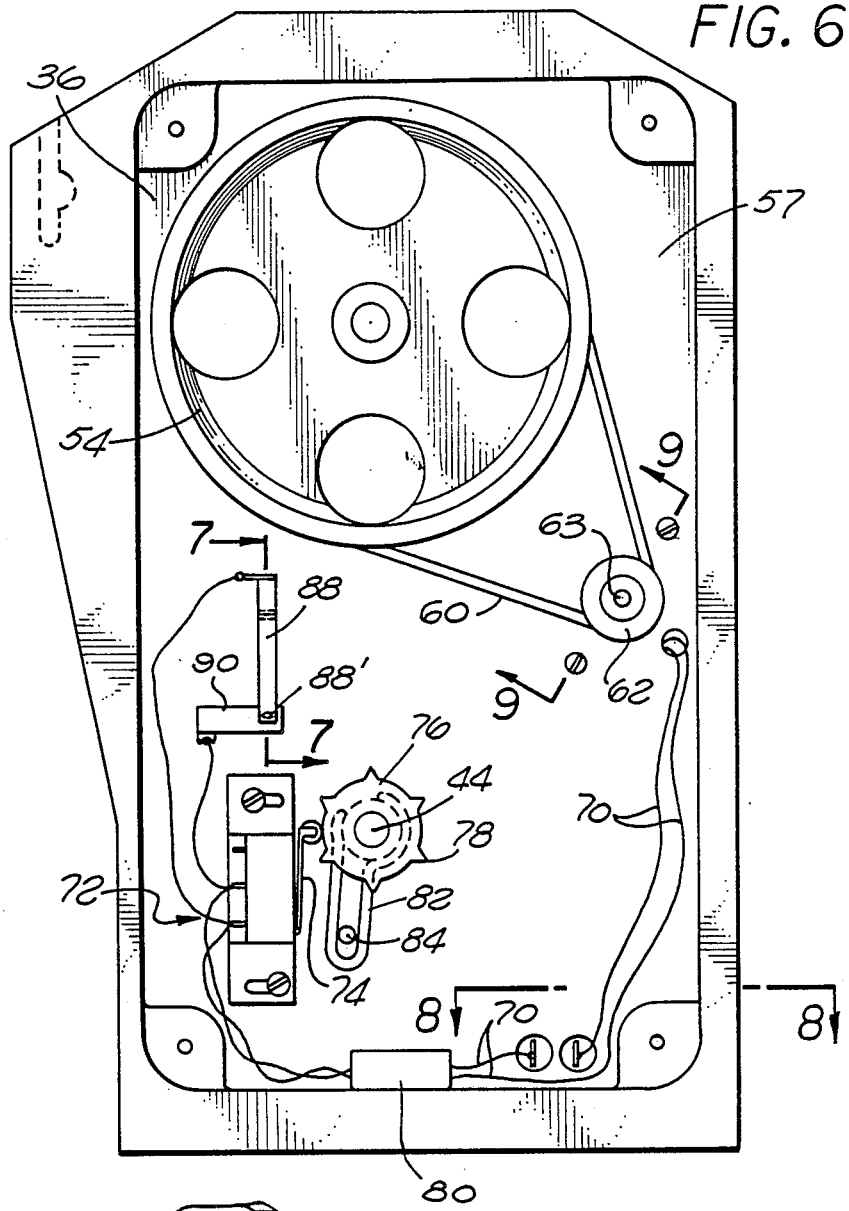
FIG. 6 is an enlarged vertical sectional view taken generally on the line 6—6 of FIG. 1.
Figure 9:
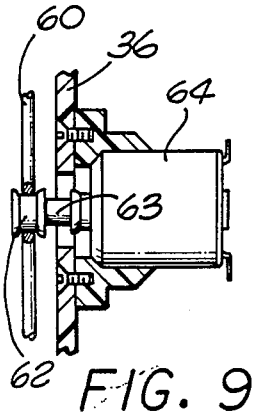
FIG. 9 is an enlarged fragmented sectional view taken generally on the line 9—9 of FIG. 6.
Figure 7:
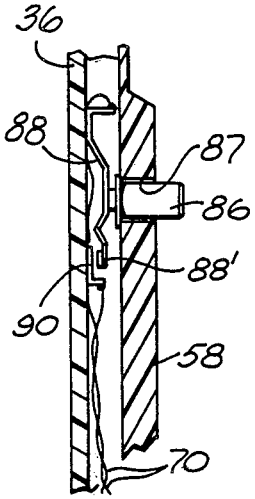
FIG. 7 is an enlarged fragmented vertical sectional view taken, generally on the line 7—7 of FIG. 6.
Figure 10:
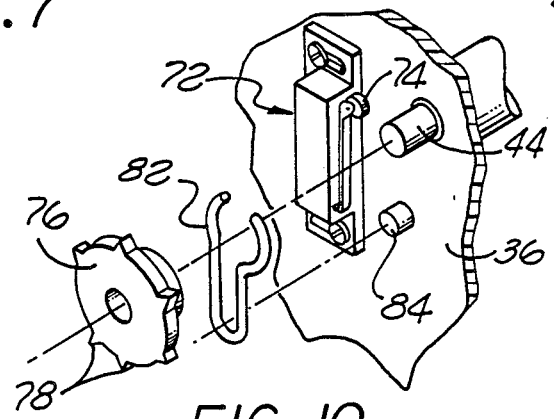
FIG. 10 is an exploded fragmented perspective view of means for intermittently activating a control unit drive motor.
Figure 8:
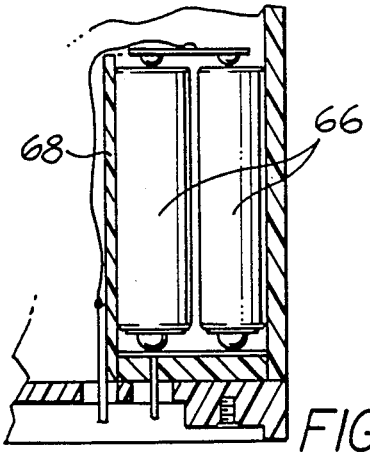
FIG. 8 is an enlarged fragmented horizontal sectional view taken generally on the line 8—8 of FIG. 6.

More specifically as viewed in FIGS. 6 and 10, a microswitch unit 72 is mounted within the pulley chamber 57 on the outboard face of the side wall 36. This switch unit 72 may be of any suitable known design to include a spring loaded sensor arm 74 responsive to a mechanical input for opening and closing internal switch components. The illustrative drawings show a sensor arm 74 positioned adjacent to a cam wheel 76 mounted on the supply reel spindle 44 for rotation therewith, wherein this cam wheel 76 includes outwardly projecting teeth 78 at circumferentially spaced positions. As the supply reel 42 is rotated by the platen roller operation to draw paper tape 14 into the machine, the cam teeth 78 engage and release the sensor arm 74 of the switch unit 72 for intermittently energizing and de-energizing the drive motor 64 resulting in take-up reel rotation for short durations on an intermittent basis. The flexible nature of the drive belt 60 provides sufficient drive slippage to prevent tape breakage. Moreover, the time delay circuit 80 may be connected with the leads 70 as a back-up switch means to de-energize the motor 64 after a limited time period in the event supply reel rotation is halted with a cam tooth 78 engaging the sensor arm 74. Still further, a brake spring 82 (FIG. 10) may be coupled between the supply reel spindle 44 and a mounting, post 84 on the side wall 36 to prevent unrestrained supply reel rotation.

Alternative switch means for manual operation is also desirably provided in the form of a pushbutton 86 protruding through a port 87 in the chamber cover plate 58. This pushbutton 86 is carried by a spring arm 88 mounted on the housing side wall 36 and including a contact 88′ adapted to engage a mating contact 90 when the pushbutton 86 is manually depressed. These contacts 88′ and 90 are conveniently connected in parallel with the switch unit 72 to permit manual energization of the motor 64 independently of the switch unit closure. Such manual operation permits used paper tape to be unwound or drawn from the take-up reel 48 for review, as will be described, followed by prompt rewinding of the tape onto the take-up reel upon depression of the pushbutton 86.

FIGS. 1–5 illustrate the construction and use of a convenient writing plate unit 92 for use in conjunction with the invention. More particularly, a generally rectangular writing plate 94 is provided with coaxially aligned and outwardly projecting support pins 96 near an upper end thereof. These support pins 96 are adapted to seat within upwardly open slots 98 formed in the housing side walls 34 and 36 to orient the writing plate 94 with a lower edge seated upon the housing 18 of the business machine 12. In this position, paper tape 14 discharged from the business machine 12 is passed over the writing plate 94 before entry into the control unit housing. Accordingly, the plate 94 provides a conveniently located flat and hard writing surface to permit edits or notes to be applied to the paper tape.

As viewed in FIGS. 2–5, a tape lock pin unit 100 is provided to lock the paper tape 14 against advancement relative to the writing plate 94. This lock pin unit 100 includes an elongated shaft 102 with semicircular cutouts 103 near opposite ends thereof to permit shaft seating into the side wall slots 98. The shaft 102 is received into the slots 98 for alignment with slot enlargements 98′ which permit shaft rotation without removal from the housing. The location of these enlargements 98′ is chosen to space the shaft 102 normally in spaced relation above the underlying writing plate 94 (FIGS. 3 and 4) for unrestricted passage of the paper tape to the take-up reel 48. However, is it is desired to lock the tape against advancement, the lock pin unit 100 may be rotated about the axis of the shaft 102 to swing a cam lobe 104 thereon into binding engagement with the tape 14 at an upper edge of the writing plate 94, as viewed in dotted lines in FIG. 3. In this locked position, a knife edge 106 joined to the shaft 102 is positioned to overlie the paper tape on the plate 94 to provide a convenient sharp edge to tear the tape (dotted lines in FIG. 3). An enlarged knob 108 at one end of the lock pin unit 100 facilitates manual grasping for easy rotational operation.

Figure 11:
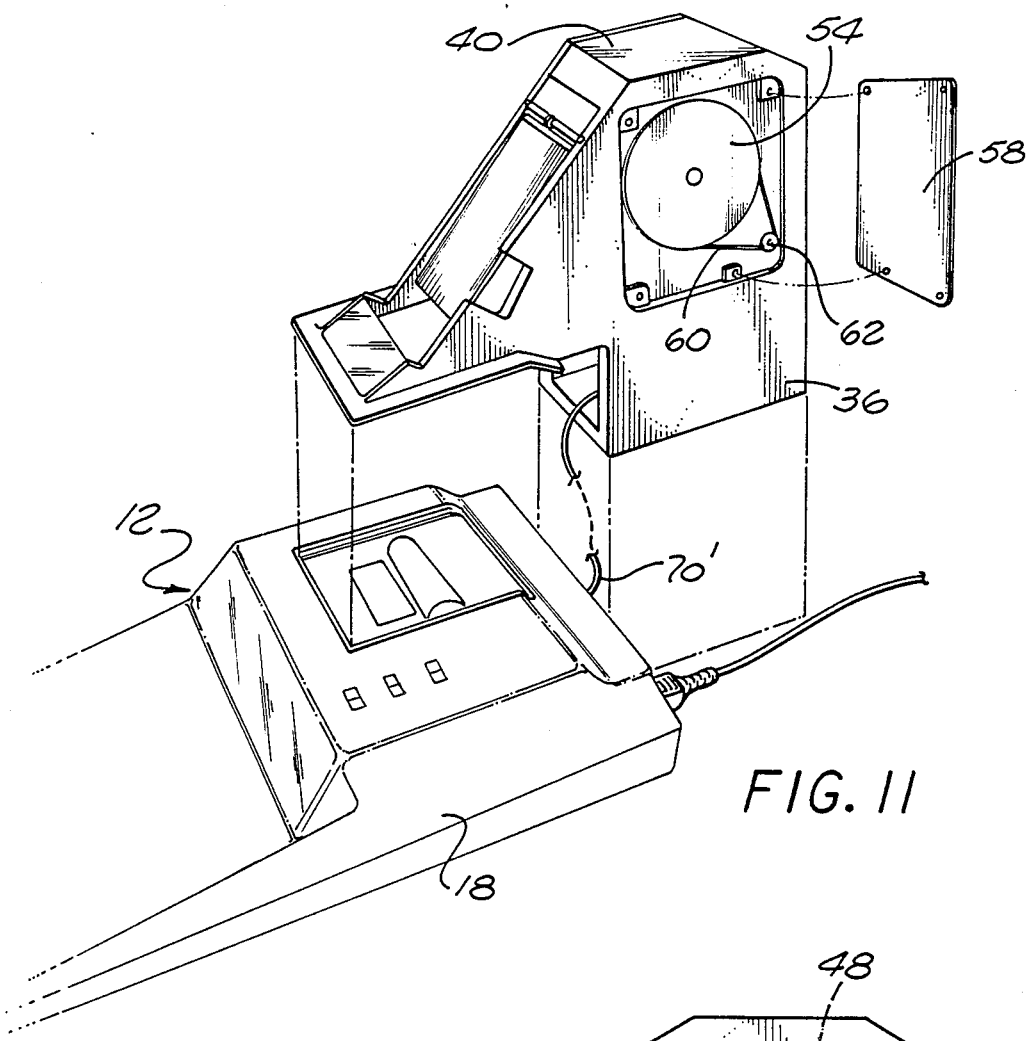
Figure 12:
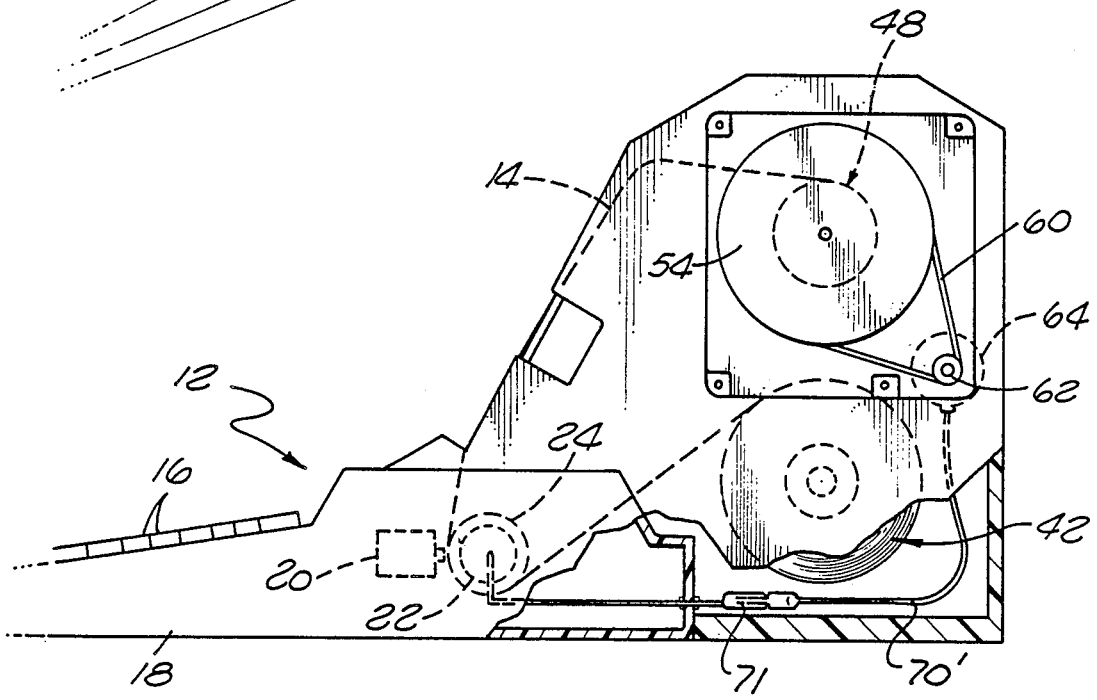
FIG. 12 is a somewhat schematic side elevation illustrating direct electrical connection between a control unit drive motor and a standard platen drive motor for a business machine.

FIGS. 11 and 12 depict an alternative preferred form of the invention, wherein components correspondingly generally with those shown and described in FIGS. 1–10 are identified by common reference numerals. In this embodiment, however, the control unit drive motor 64 is electrically coupled for synchronous intermittent operation with the platen drive motor 24 of the business machine 12. More particularly, the control unit drive motor 64 is electrically coupled by leads 70′ through a fitting 71 for series connection with the platen drive motor 24, with both motors 24 and 64 being connected in turn to a standard power supply for the business machine. During normal machine operation, the platen drive motor 24 is energized intermittently, typically by depression of a return key on the machine 12, resulting in brief rotational driving of the platen roller 22. Such operation of the platen drive motor 24 is accompanied by concurrent energization of the control unit drive motor 64 to drive the take-up reel 48 via the drive and driven pulleys 62 and 54. The drive ratio between these pulleys, relative to the advancement rate of the platen roller 22, is sufficient to insure tape take-up particularly when excess tape slack is present due, for example, to tape withdrawal from the take-up reel for review purposes. However, the drive belt 60 is sufficiently flexible to accommodate pulley slippage without significant risk of tape breakage.

From the foregoing, it will be appreciated that the improved paper tape control unit 10 of the present invention provides a relatively simple yet highly versatile mechanism for controlling and storing paper tape discharged from a business machine. The paper tape control unit handles paper tape efficiently and in a manner which beneficially prevents creation of undesired tape slack at all times. Importantly, the embodiments of the invention provide automatic, intermittent motorized advancement of a take-up reel to rewind discharged paper tape discharged from the machine.

A variety of further modifications and improvements to the present invention will be apparent to those skilled in the art. Accordingly, no limitation on the invention is intended by way of the foregoing description or the accompanying drawings, except as set forth in the appended claims.

What is claimed is:

1. A paper tape control unit adapted for use with a business machine or the like having means for drawing and using an elongated strip of paper tape, and then for discharging the paper tape, said control unit comprising:

a control unit housing;

a supply reel carrying a roll of paper tape in elongated strip form for supply to the business machine;

a take-up reel for rewinding of the paper tape discharged from the machine;

means for supporting said supply and take-up reels for rotation within said housing, said supply reel being positioned for drawing of the paper tape thereon into association with the business machine by operation of said drawing means for use of the paper tape by the business machine, said supply reel being rotatably driven by said drawing means as the paper tape is drawn from said supply reel, and said take-up reel being positioned for rewinding thereonto of the paper tape used by said business machine;

drive means coupled to the take-up reel to rotatably drive said take-up reel for rewinding of the paper tape thereonto; and means for intermittently activating said drive means to rewind the paper tape in an intermittent manner, said means for intermittently activating said drive means including switch means for energizing said drive means and means carried by said supply reel for movement therewith, said means carried by said supply wheel being engageable with said switch means for intermittently energizing said drive means in response to supply reel rotation.

2. The paper tape control unit of claim 1 wherein said drive means comprises a motor having an output coupled to said take-up reel, and wherein said means carried by said supply reel comprises a cam wheel including means engageable with said switch means for intermittently energizing said motor in response to supply reel rotation.

3. The paper tape control unit of claim 2 further including circuit means for preventing energization of said motor beyond a predetermined time period.

4. The paper tape control unit of claim 2 further including a power source contained within said control unit housing.

5. The paper tape control unit of claim 4 wherein said power source is at least one battery.

6. The paper tape control unit of claim 1 further including second switch means for manually energizing said drive means.

7. The paper tape control unit of claim 1 further including manual switch means for energizing said drive means.

8. The paper tape control unit of claim 1 wherein said drive means further includes a drive motor located within said control unit housing, a drive pulley driven by said drive motor, a driven pulley rotatable with said take-up reel, and a drive belt connected between said drive and driven pulleys.

9. The paper tape control unit of claim 8 wherein said drive belt comprises a spring belt.

10. The paper tape control unit of claim 1 further including a writing plate unit carried on said housing in a position for passage thereover of paper tape used by the business machine upon discharge of the paper tape from the business machine toward said take-up reel for rewinding.

11. The paper tape control unit of claim 10 further including a lock pin unit rotatably supported by said control unit housing and including means for pinching the paper tape against said writing plate unit to releasably prevent rewinding of the paper tape onto the take-up reel.

12. The paper tape control unit of claim 11 wherein said lock pin unit further includes a knife edge for tearing of the paper tape at a selected position.

13. A paper tape control unit adapted for use with a business machine or the like having means for drawing and using an elongated strip of paper tape, and then for discharging the paper tape, said control unit comprising:

a control unit housing;

a supply reel carrying a roll of paper tape in elongated strip form for supply to the business machine;

a take-up reel for rewinding of the paper tape discharged from the machine;

means for supporting said supply and take-up reels for rotation within said housing, said supply reel being positioned for drawing of the paper tape thereon into association with the business machine by operation of said drawing means for use of the paper tape by the business machine, said supply reel being rotatably driven by said drawing means as the paper tape is drawn from said supply reel, and said take-up reel being positioned for rewinding thereonto of the paper tape used by said business machine; and drive means coupled to the take-up reel to rotatably drive said take-up reel for rewinding of the paper tape thereonto;

wherein said drawing means includes a first motor adapted for intermittent energization upon operation of the business machine, and said drive means comprises a second motor coupled electrically to said first motor for synchronous intermittent operation.

* * * * *